US010675672B2

(12) United States Patent
Beisner

(10) Patent No.: US 10,675,672 B2
(45) Date of Patent: Jun. 9, 2020

(54) PNEUMATIC TOOL SYSTEM

(71) Applicant: Sikorsky Aircraft Corporation, Stratford, CT (US)

(72) Inventor: John William Beisner, Madison, CT (US)

(73) Assignee: SIKORSKY AIRCRAFT CORPORATION, Stratford, CT (US)

( * ) Notice: Subject to any disclaimer, the term of this patent is extended or adjusted under 35 U.S.C. 154(b) by 115 days.

(21) Appl. No.: 15/554,227

(22) PCT Filed: Feb. 29, 2016

(86) PCT No.: PCT/US2016/020088
§ 371 (c)(1),
(2) Date: Aug. 29, 2017

(87) PCT Pub. No.: WO2016/140917
PCT Pub. Date: Sep. 9, 2016

(65) Prior Publication Data

US 2018/0085821 A1 Mar. 29, 2018

Related U.S. Application Data

(60) Provisional application No. 62/127,043, filed on Mar. 2, 2015.

(51) Int. Cl.

| | |
|---|---|
| ***B21J 15/28*** | (2006.01) |
| ***B21J 15/10*** | (2006.01) |
| ***B21J 15/14*** | (2006.01) |
| ***B21J 15/18*** | (2006.01) |

(52) U.S. Cl.
CPC ..... *B21J 15/28* (2013.01); *B21J 15/105* (2013.01); *B21J 15/142* (2013.01); *B21J 15/18* (2013.01)

(58) Field of Classification Search
CPC . B21J 15/28; B21J 15/142; B21J 15/18; B21J 15/105
See application file for complete search history.

(56) References Cited

U.S. PATENT DOCUMENTS

| | | | |
|---|---|---|---|
| 3,559,269 | A | 2/1971 | Schmitt et al. |
| 6,536,100 | B2 | 3/2003 | Sarh et al. |
| 6,692,200 | B2 | 2/2004 | Peterson |

(Continued)

FOREIGN PATENT DOCUMENTS

| | | | |
|---|---|---|---|
| DE | 69010319 | T2 | 1/1995 |
| JP | 2000218337 | A | 8/2000 |
| WO | 2014081404 | A1 | 5/2014 |

OTHER PUBLICATIONS

International Search Report and Written Opinion; International Application No. PCT/US2016/020088; International Filing Date: Feb. 29, 2016; dated May 2, 2016; 14 Pages.

*Primary Examiner* — Rick K Chang
(74) *Attorney, Agent, or Firm* — Cantor Colburn LLP

(57) ABSTRACT

A tool system is provided and includes a securing element, a hammer element configured to drive a member toward the securing element and first and second orientation elements rigidly disposed on the securing and hammer elements, respectively. The securing and hammer elements have respective operational axes and the first and second orientation elements respectively include orientation sensors configured to cooperatively determine a relative orientation of the respective operational axes.

10 Claims, 4 Drawing Sheets

(56) References Cited

U.S. PATENT DOCUMENTS

| | | | | |
|---|---|---|---|---|
| 6,913,088 | B2 | 7/2005 | Berger | |
| 7,375,361 | B2 | 5/2008 | Turner et al. | |
| 7,540,334 | B2 | 6/2009 | Gass et al. | |
| 8,316,524 | B1 * | 11/2012 | LeMieux | B21J 15/10 29/524.1 |
| 2003/0126739 | A1 | 7/2003 | Prater | |
| 2013/0081242 | A1 | 4/2013 | Lemieux | |
| 2013/0192050 | A1 | 8/2013 | LeMieux | |

* cited by examiner

PNEUMATIC TOOL SYSTEM

CROSS REFERENCE TO RELATED APPLICATIONS

This application is a National Stage application of PCT/US2016/020088, filed Feb. 29, 2016, which claims the benefit of U. S. Provisional Application No. 62/127,043, filed Mar. 2, 2015, both of which are incorporated by reference in their entirety herein.

BACKGROUND OF THE INVENTION

The subject matter disclosed herein relates to a pneumatic tool system and, more particularly, to a zero-tilt pneumatic tool system including a hammer and bucking bar.

The process of fastening rivets in an aircraft fuselage is an extremely manual process, one that causes a lot of scrap and rework. The process requires that a bucking bar be held by one operator on one side of the fuselage while another operator holds a pneumatic hammer on the other side. The operator holding the pneumatic hammer actuates the pneumatic hammer to drive a rivet toward the bucking bar and into the fuselage.

In order for the process to result in an acceptable riveted joint, the pneumatic hammer and the bucking bar must all be oriented with respect to one another to a relatively precise degree. In particular, the bucking bar needs to be oriented in accordance with an orientation of the pneumatic hammer. However, since the operators often have difficulty holding the two elements in place at their proper respective orientations and cannot see through the fuselage to judge how they might improve those orientations, the operators can only manually hold the bucking bar and the pneumatic hammer while estimating the respective orientations.

The difficulties noted above tend to result in crooked or otherwise malformed rivets that need to be scrapped and reworked.

BRIEF DESCRIPTION OF THE INVENTION

According to one aspect of the invention, a tool system is provided and includes a securing element, a hammer element configured to drive a member toward the securing element and first and second orientation elements rigidly disposed on the securing and hammer elements, respectively. The securing and hammer elements have respective operational axes and the first and second orientation elements respectively include orientation sensors configured to cooperatively determine a relative orientation of the respective operational axes.

In accordance with additional or alternative embodiments, the securing element includes a bucking bar and the hammer element includes a rivet gun.

In accordance with additional or alternative embodiments, the member includes a rivet.

In accordance with additional or alternative embodiments, the operational axis of the securing element extends along a thickness dimension thereof and the operational axis of the hammer element extends along a longitudinal axis of a barrel of the rivet gun.

In accordance with additional or alternative embodiments, the hammer element includes a trigger, which is actuatable to initiate a driving of the member toward the securing element, a trigger lock, which is coupled to the trigger and configured to permit or prevent trigger actuation, and a controller configured to control the trigger lock to permit or prevent the trigger actuation in accordance with the relative orientation.

In accordance with additional or alternative embodiments, the controller is configured to control the trigger lock to permit or prevent the trigger actuation in accordance with the relative orientation being within a predefined range.

In accordance with additional or alternative embodiments, the hammer element further includes a wobble servo, which is controllable by the controller to re-orient the operational axis of the hammer element.

In accordance with additional or alternative embodiments, at least one of the first and second orientation elements includes a display unit configured to display information reflective of the relative orientation.

In accordance with additional or alternative embodiments, each of the first and second orientation elements includes a display unit configured to display information reflective of the relative orientation.

According to another aspect of the invention, a tool system is provided and includes a bucking bar having an operational axis extending along a thickness dimension thereof, a rivet gun including a barrel and having an operational axis extending along a longitudinal axis of the barrel, the rivet gun being configured to drive a rivet toward the bucking bar and first and second orientation elements rigidly disposed on the bucking bar and the rivet gun, respectively, the first and second orientation elements respectively including orientation sensors configured to cooperatively determine a relative orientation of the respective operational axes.

In accordance with additional or alternative embodiments, the rivet gun includes a trigger, which is actuatable to initiate a driving of the rivet toward the bucking bar, a trigger lock, which is coupled to the trigger and configured to permit or prevent trigger actuation, and a controller configured to control the trigger lock to permit or prevent the trigger actuation in accordance with the relative orientation.

In accordance with additional or alternative embodiments, the controller is configured to control the trigger lock to permit or prevent the trigger actuation in accordance with the relative orientation being within a predefined range.

In accordance with additional or alternative embodiments, the rivet gun further includes a wobble servo, which is controllable by the controller to re-orient the operational axis of the rivet gun.

In accordance with additional or alternative embodiments, at least one of the first and second orientation elements includes a display unit configured to display information reflective of the relative orientation.

In accordance with additional or alternative embodiments, each of the first and second orientation elements includes a display unit configured to display information reflective of the relative orientation.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

As will be described below, zero tilt tools implement orientation sensors on bucking bars and rivet guns. With such sensors in place and displays installed for the operators, the operators can see at what degree of tilt the rivet gun or bucking bar is in respect to the other tool.

Figure 1:
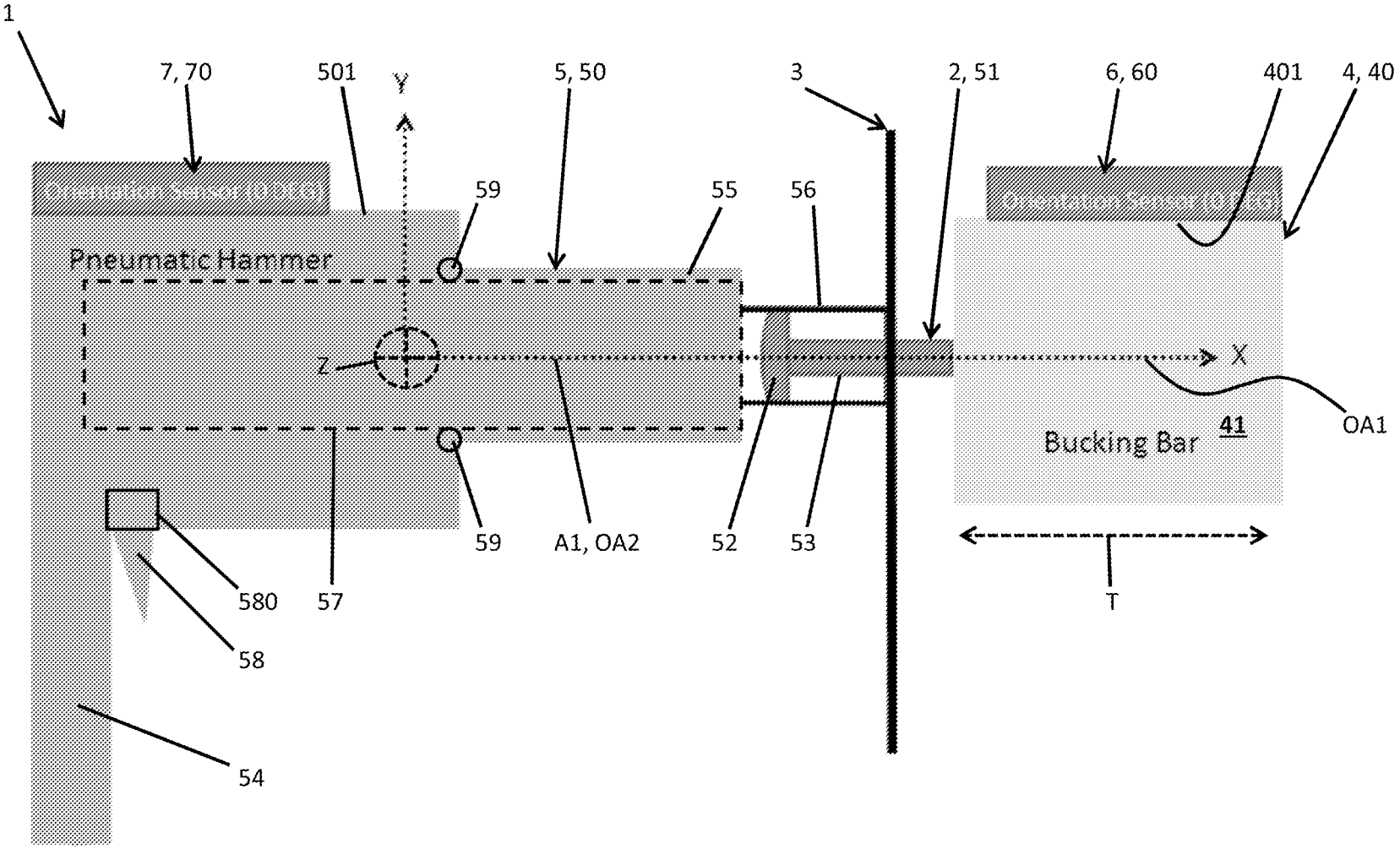
FIG. 1 is a side view of a tool system in accordance with embodiments.
Figure 2:
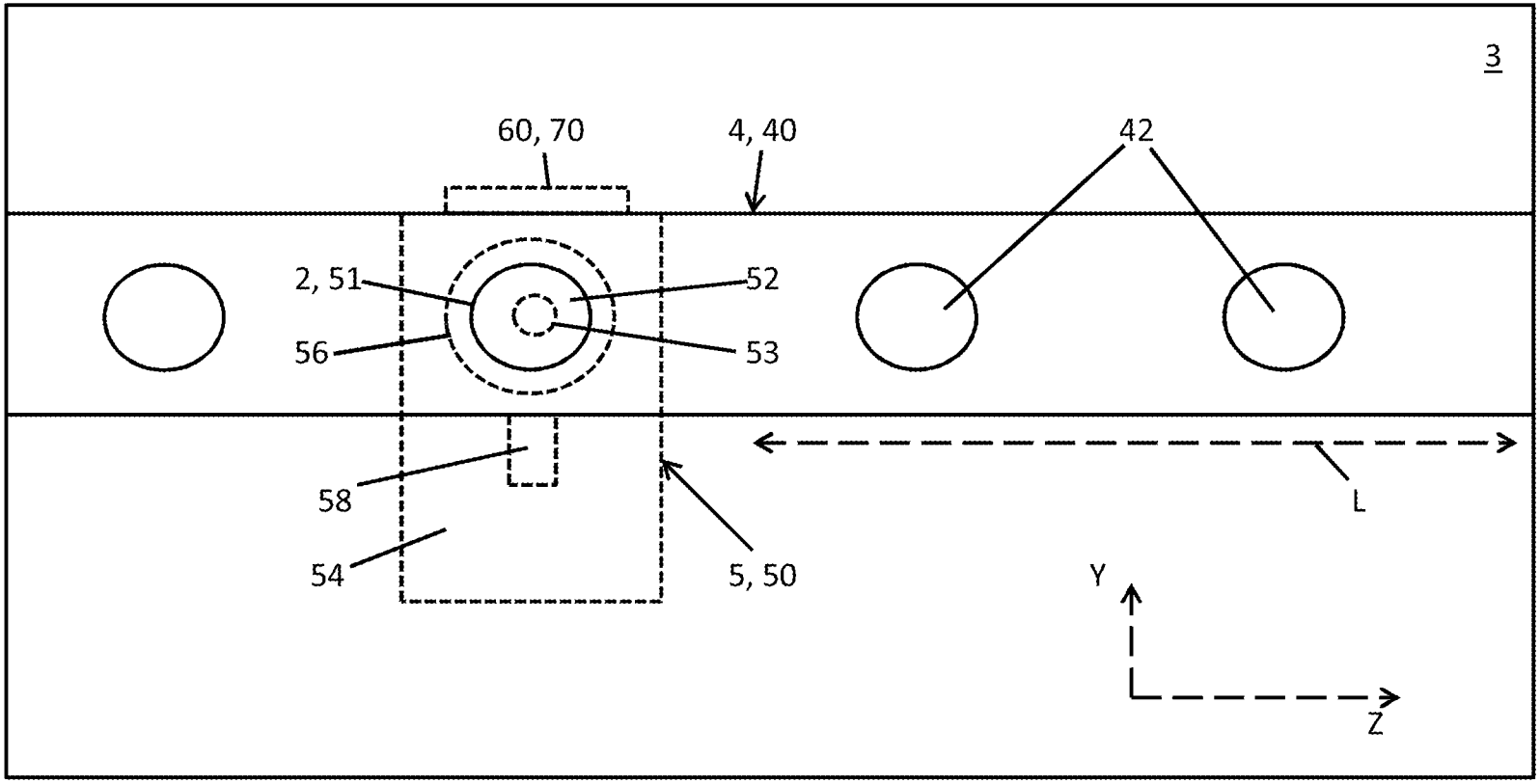
FIG. 2 is a plan view of the tool system of FIG. 1.

With reference to FIGS. 1 and 2, a pneumatic or non-pneumatic tool system 1 is provided for various tooling purposes such as, but not limited to, securably driving members 2 into an aircraft fuselage 3. While this system 1 can be applied for use in those various tooling purposes, for purposes of clarity and brevity the following description will relate only to the embodiments in which the system 1 is used to securably drive the members 2 into the aircraft fuselage 3. It is to be understood, however, that the description is merely exemplary and that other configurations and uses are possible. In any case, the system 1 includes a securing element 4, a hammer element 5, a first orientation element 6 and a second orientation element 7.

The securing element 4 may be provided as a bucking bar 40 that is extendible in a length dimension L thereof along the Z-axis in FIG. 1 (i.e., the Y-Z plane of the fuselage 3) and in a thickness dimension T thereof along the X-axis in FIG. 1. The securing element 4 may be formed by various methods including, but not limited to, 3-D printing and has a body 41, which is formed to define multiple securing locations 42 along its length dimension L. In cross-section, as shown in FIG. 1, the body 41 may have a block-shape and may be formed of materials that are deformable by and bondable to the members 2 as they are driven into the body 41.

The hammer element 5 may be provided as a hand-held and portable rivet gun 50 and the members 2 may be provided as rivets 51 and the following description will relate to this exemplary case and the exemplary case in which the securing element 4 is provided as the bucking bar 40.

The rivet gun 50 is configured to drive the rivets 51 toward the bucking bar 40 in order to secure the rivets 51 in the aircraft fuselage 3. The rivets 51 each include a head portion 52 and a shank portion 53 that extends away from the head portion 52. The rivet gun 50 includes a handle portion 54, a barrel 55 disposed on the handle portion 54, a barrel chamber 56 disposed at a distal end of the barrel 55, a firing mechanism 57 disposed within the barrel 55 and a trigger 58. In operation, an operator handles the handle portion 54 to hold the barrel chamber 56 against the aircraft fuselage 3 and around the rivet 51. The operator then pulls the trigger 58 to actuate the firing mechanism 57 when the rivet gun 50 is oriented properly. The firing mechanism 57 may be provided as a pneumatic firing mechanism, which drives air along a longitudinal axis A1 of the barrel 55 toward the head portion 52 of the member 2. The impact of the air on the head portion 52 drives the shank portion 53 through the aircraft fuselage 3 and into the bucking bar 40.

The first orientation element 6 is rigidly disposed on the bucking bar 40 and includes at least a first orientation sensor 60 and the second orientation element 7 is rigidly disposed on the rivet gun 50 and includes at least a second orientation sensor 70. In accordance with embodiments, the first orientation element 6 may be disposed on an upper surface 401 of the bucking bar 40 and the second orientation element 7 may be similarly disposed on an upper surface 501 of the barrel 55 of the rivet gun 50. In any case, the bucking bar 40 has a first operational axis OA1 that extends along the thickness dimension T and the rivet gun 50 has a second operational axis OA2 that extends in parallel with the longitudinal axis A1 of the barrel 55. The first and second orientation sensors 60 and 70 are configured to communicate with one another and to thereby cooperatively determine a relative orientation of the first and second operational axes OA1 and OA2.

Figure 3B:
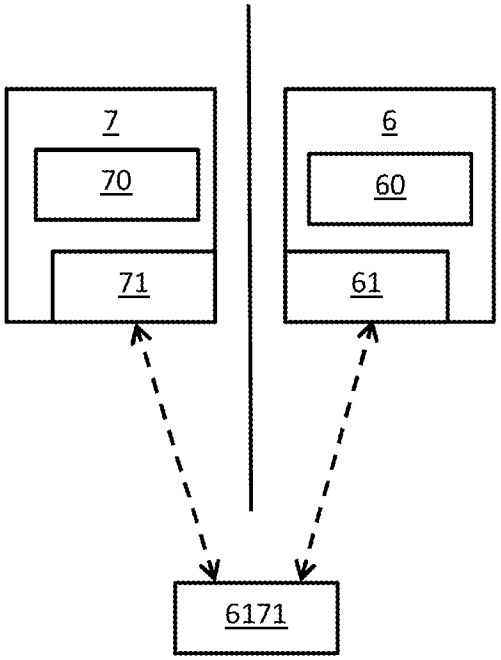
FIG. 3B is a schematic diagram of wireless communications between orientation elements of the tool system of FIGS. 1 and 2.
Figure 3A:
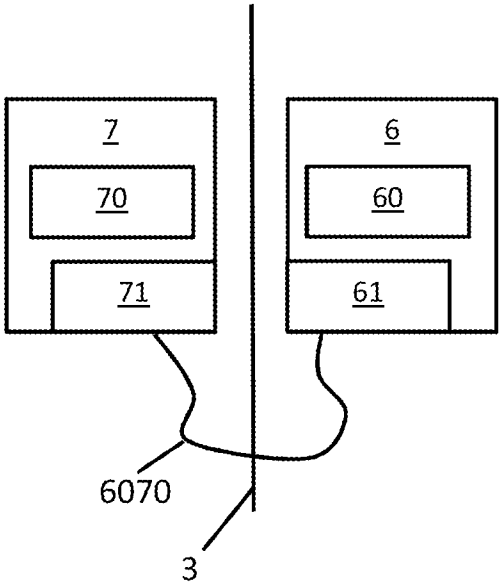
FIG. 3A is a schematic diagram of wired communications between orientation elements of the tool system of FIGS. 1 and 2.

With reference to FIGS. 3A and 3B, the communication between the first and second orientation sensors 60 and 70 may be achieved by way of wired or wireless communications between the first and second orientation elements 6 and 7. As shown in FIG. 3A, the wired communication may be enabled by wiring 6070 that extends through the aircraft fuselage 3 and is coupled at opposite ends thereof to respective transmitters 61, 71 of the first orientation element 6 and the second orientation element 7. As shown in FIG. 3B, the wireless communication may be enabled by the respective transmitters 61, 71 of the first and second orientation elements 6 and 7 being disposed in signal communication with each other or by way of a remote transmission/reception module 6171.

Figure 4:
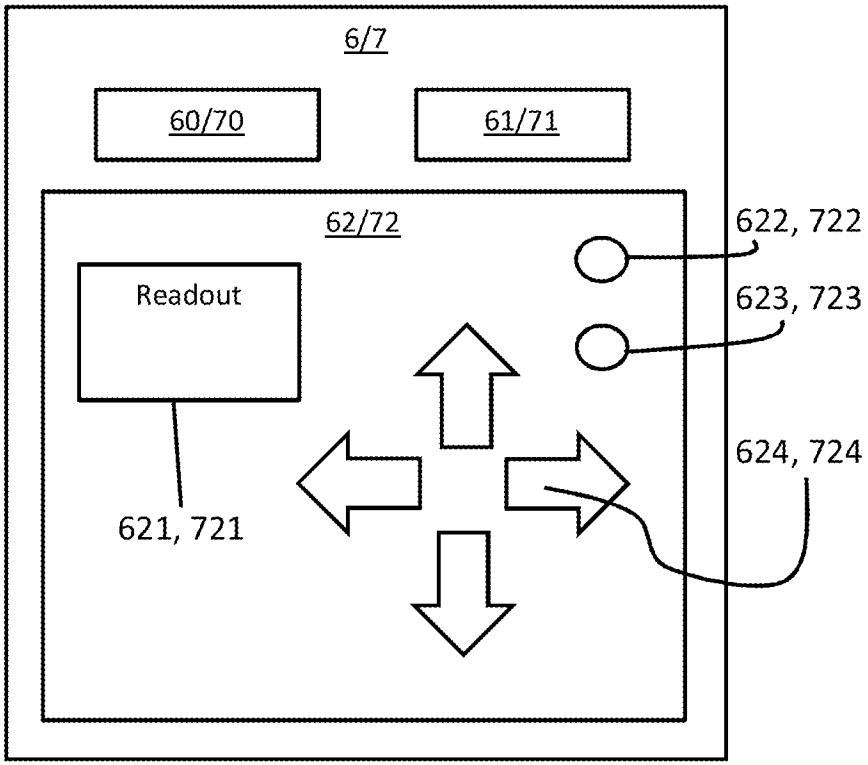
FIG. 4 is a schematic illustration of a display unit of the tool system of FIGS. 1 and 2 in accordance with embodiments.

With reference to FIG. 4 and, in accordance with further embodiments, at least one or both of the first and second orientation elements 6 and 7 may also include a display unit 62/72 that displays relevant information to the corresponding operator. This information may include, but is not limited to, a readout 621/721 of the determined relative orientation of the first and second operational axes OA1 and OA2, a first indication 622/722 that the determined relative orientation of the first and second operational axes OA1 and OA2 is within a predefined acceptable angular range for proper driving of the rivet 51, a second indication 623/723 that the determined relative orientation of the first and second operational axes OA1 and OA2 is not within the predefined acceptable angular range for the proper driving of the rivet 51 and a directional arrow 624/724 indicating how the corresponding operator should manipulate the bucking bar 40 or the rivet gun 50 to bring the determined relative orientation of the first and second operational axes OA1 and OA2 within the predefined acceptable angular range for the proper driving of the rivet 51.

With the first and second orientation elements 6 and 7 as described above rigidly disposed on the bucking bar 40 and the rivet gun 50, the operators are aided in the aiming process and the likelihood that a given rivet will be properly driven through the aircraft fuselage 3 and into the bucking bar 40 is increased. Moreover, time loss and expense of improperly driven rivets 51 is avoided or at least substantially reduced.

Figure 5:
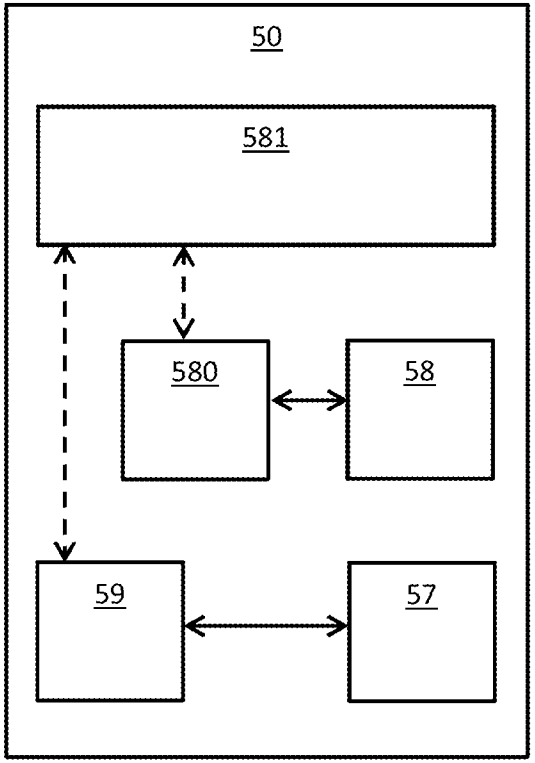
FIG. 5 is a schematic diagram of additional features of the tool system of FIGS. 1 and 2 in accordance with embodiments.

With reference to FIG. 5, while the trigger 58 is actuatable to initiate a firing of the firing mechanism 57 and a resultant driving of the rivet 51 toward the bucking bar 40, the rivet gun 50 may further include a trigger lock 580 and a controller 581. The trigger lock 580 may be coupled to the trigger 58 and configured to permit or prevent actuation of the trigger 58. Meanwhile, the controller 581 may be configured to control the trigger lock 580 to permit or prevent such actuation of the trigger 58 in accordance with the determined relative orientation of the first and second operational axes OA1 and OA2 or, more particularly, in accordance with the determined relative orientation of the first and second operational axes OA1 and OA2 being within the predefined acceptable angular range for the proper driving of the rivet 51.

With the trigger lock 580 and the controller 581 provided as described above, the operator of the rivet gun 50 may be effectively prevented from actuating the trigger 58 unless and until the rivet gun 50 is re-oriented relative to the bucking bar or vice versa, within the predefined acceptable angular range. Thus, the risk of an improper riveting process being undertaken is avoided or at least substantially reduced.

Still referring to FIG. 5 and with additional reference back to FIG. 1, the rivet gun 50 may further include a wobble servo 59. The wobble servo 59 is operably interposed between the barrel 55 and the firing mechanism 57 and may be disposed to passively or actively re-orient the second operational axis OA2 in accordance with the determined relative orientation of the first and second operational axes OA1 and OA2 or, more particularly, in accordance with the determined relative orientation of the first and second operational axes OA1 and OA2 being within the predefined acceptable angular range for the proper driving of the rivet 51.

In the former case, the wobble servo 59 may be provided as an elastic element that prevents undesirable movement by the operator from being transferred from the handle portion 54 to the firing mechanism 57. That is, if the operator's hand is shaking during the lining up of the bucking bar 40 and the rivet gun 50, the wobble servo 59 will reduce the likelihood that the shaking will cause the firing mechanism 57 to become misaligned with the bucking bar 40 even if the rivet gun 50 as whole is otherwise misaligned.

In the latter case, the wobble servo 59 may be controllable by the controller 581 to effectively re-orient the second operational axis OA2 of the rivet gun 50. Here, if the operator's hand is shaking or moving during the lining up of the bucking bar 40 and the rivet gun 50 and the controller 581 determines that the relative orientation of the first and second operational axes OA1 and OA2 is temporarily within the predefined acceptable angular range for the proper driving of the rivet 51, the controller 581 may control the wobble servo 59 to maintain the orientation of the second operational axis OA2. This could be achieved by the controller 581 instructing the wobble servo 59 to manipulate an orientation of the firing mechanism 57 in order to compensate for the shaking or moving of the operator's hand so that the relative orientation of the first and second operational axes OA1 and OA2 remains within the predefined acceptable angular range.

The description provided above improves rivet installation and will potentially save time and money by giving the operators on either side of the aircraft fuselage 3 the information they need to orient the system 1 tools. With this in mind, it is understood that any hand tool can be developed to have an orientation sensor integrated as described herein. Such tools may include, but are not limited to, hand tools and drills, torque wrenches, paint guns, impact wrenches and any other pneumatic or non-pneumatic tool.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A tool system, comprising:

a securing element comprising a bucking bar;

a hammer element comprising a rivet gun configured to drive a member toward the securing element, the hammer element including a trigger, which is actuatable to initiate a driving of the member toward the securing element, a trigger lock, which is coupled to the trigger and configured to permit or prevent trigger actuation, and a controller configured to control the trigger lock to permit or prevent the trigger actuation in accordance with the relative orientation, the hammer element further including a wobble servo, which is controllable by the controller to re-orient the operational axis of the hammer element; and first and second orientation elements rigidly disposed on the securing and hammer elements, respectively, the securing and hammer elements having respective operational axes and the first and second orientation elements respectively comprising orientation sensors configured to cooperatively determine a relative alignment of the respective operational axes.

2. The tool system according to claim 1, wherein the member comprises a rivet.

3. The tool system according to claim 1, wherein the operational axis of the securing element extends along a thickness dimension thereof and the operational axis of the hammer element extends along a longitudinal axis of a barrel of the rivet gun.

4. The tool system according to claim 1, wherein the controller is configured to control the trigger lock to permit or prevent the trigger actuation in accordance with the relative orientation being within a predefined range.

5. The tool system according to claim 1, wherein at least one of the first and second orientation elements comprises a display unit configured to display information reflective of the relative orientation.

6. The tool system according to claim 1, wherein each of the first and second orientation elements comprises a display unit configured to display information reflective of the relative orientation.

7. A tool system, comprising:

a bucking bar having an operational axis extending along a thickness dimension thereof;

a rivet gun including a barrel and having an operational axis extending along a longitudinal axis of the barrel, the rivet gun being configured to drive a rivet toward the bucking bar, the rivet gun including a trigger, which is actuatable to initiate a driving of the member toward the securing element, a trigger lock, which is coupled to the trigger and configured to permit or prevent trigger actuation, and a controller configured to control the trigger lock to permit or prevent the trigger actuation in accordance with the relative orientation, the rivet gun further including a wobble servo, which is controllable by the controller to re-orient the operational axis of the rivet gun; and first and second orientation elements rigidly disposed on the bucking bar and the rivet gun, respectively, the first and second orientation elements respectively comprising orientation sensors configured to cooperatively determine a relative alignment of the respective operational axes.

8. The tool system according to claim 7, wherein the controller is configured to control the trigger lock to permit or prevent the trigger actuation in accordance with the relative orientation being within a predefined range.

9. The tool system according to claim 7, wherein at least one of the first and second orientation elements comprises a display unit configured to display information reflective of the relative orientation.

10. The tool system according to claim 7, wherein each of the first and second orientation elements comprises a display unit configured to display information reflective of the relative orientation.

* * * * *